US010688368B2

(12) United States Patent
Kovarik et al.

(10) Patent No.: US 10,688,368 B2
(45) Date of Patent: Jun. 23, 2020

(54) METHOD AND SYSTEM FOR IMPROVING GOLF PUTTING ACCURACY USING A BIRDIE-LINE GOLF GLOVE AND STRAIGHT-EDGED PUTTER GRIP

(71) Applicants: Carter J. Kovarik, Englewood, CO (US); Joseph E. Kovarik, Englewood, CO (US)

(72) Inventors: Carter J. Kovarik, Englewood, CO (US); Joseph E. Kovarik, Englewood, CO (US)

( * ) Notice: Subject to any disclaimer, the term of this patent is extended or adjusted under 35 U.S.C. 154(b) by 0 days.

(21) Appl. No.: 15/918,520

(22) Filed: Mar. 12, 2018

(65) Prior Publication Data

US 2018/0264340 A1 Sep. 20, 2018

Related U.S. Application Data

(60) Provisional application No. 62/472,282, filed on Mar. 16, 2017.

(51) Int. Cl.
*A63B 69/36* (2006.01)
*A63B 71/14* (2006.01)
(Continued)

(52) U.S. Cl.
CPC ..... *A63B 69/3685* (2013.01); *A63B 53/007* (2013.01); *A63B 53/14* (2013.01);
(Continued)

(58) Field of Classification Search
CPC ..... A63B 71/14; A63B 71/08
See application file for complete search history.

(56) References Cited

U.S. PATENT DOCUMENTS 1,677,099 A 9/1927 Harness
2,258,999 A 4/1939 Nunn
(Continued)

FOREIGN PATENT DOCUMENTS

WO WO2000-20078 4/2000
WO WO2007-120058 10/2009

*Primary Examiner* — Eugene L Kim
*Assistant Examiner* — Christopher Glenn
(74) *Attorney, Agent, or Firm* — Sheridan Ross P.C.

(57) ABSTRACT

A method and system for improving the accuracy of putting a golf ball that includes a golf glove for use with a putter grip that has a straight edge, with the golf glove having a visual line alignment feature/illustration that allows a golfer to place his or her hand in a repeatable, proper position on the grip of the putter. The golf glove employed is devoid of any putter attachment feature, such as hook-and-loop fastener material on the glove or the golf grip and is further devoid of any indicia affixed to the back-hand portion of a glove that could be viewed as an alignment indicia, as it only complicates and confuses a golfer when putting. Preferred embodiments include a golf glove that includes a marking forming a straight line that diagonally crosses the palm portion of the glove such that, when worn by a wearer, provides the wearer with a visual indication of the proper gripping position of a golf putter, such putter having a grip that has at least one flat surface and an edge extending down the axial length of the grip that can be aligned with the visual indicator markings/line on the golf glove.

6 Claims, 2 Drawing Sheets

(51) Int. Cl.

| | |
|---|---|
| ***A63B 60/10*** | (2015.01) |
| ***A63B 53/00*** | (2015.01) |
| ***A63B 53/14*** | (2015.01) |
| ***A63B 71/06*** | (2006.01) |

(52) U.S. Cl.
CPC ..... *A63B 60/10* (2015.10); *A63B 69/3608* (2013.01); *A63B 69/3676* (2013.01); *A63B 71/146* (2013.01); *A63B 2071/0694* (2013.01)

(56) References Cited

U.S. PATENT DOCUMENTS 3,109,653 A 1/1961 Biggs
3,219,348 A 3/1961 Dishner, Jr.
3,263,998 A 2/1964 Fanning
3,459,426 A 11/1966 Sherwood
3,648,292 A 3/1972 Strickler
3,848,874 A 11/1974 Elkins, Jr.
3,863,271 A 2/1975 Moroney
4,000,903 A * 1/1977 Swanson ..... A63B 69/3608 473/205
4,116,440 A * 9/1978 Takeshima ..... A63B 60/10 473/203
4,329,741 A 5/1982 Bach
4,537,403 A 8/1985 Farina
4,746,120 A 5/1988 Mockovak
4,962,547 A 10/1990 Minnick
5,027,439 A * 7/1991 Spector ..... A63B 59/00 2/20
5,123,646 A 1/1992 Overby
5,133,555 A 7/1992 Bailey
5,167,416 A * 12/1992 Painter ..... A63B 53/14 473/204
5,253,367 A 10/1993 Lappley
5,460,372 A 10/1995 Cook
D377,070 S 12/1996 Gurrola
5,634,214 A 6/1997 St. Ville
5,715,539 A 2/1998 Benecki et al.
5,836,828 A 11/1998 Sinton
5,993,327 A 11/1999 Terrell
6,110,054 A 8/2000 Rodarte
6,152,832 A * 11/2000 Chandler, III ..... A63B 53/007 473/293
6,272,686 B1 * 8/2001 Liu ..... A63B 71/146 2/161.1
6,698,027 B2 3/2004 Park
6,902,492 B1 6/2005 Strand
7,211,004 B2 * 5/2007 DeMarco ..... A41D 19/01552 2/161.2
7,794,332 B2 9/2010 Johnson
8,092,317 B2 1/2012 Johnson
8,096,893 B2 1/2012 Ferris
8,192,296 B2 * 6/2012 Pinkart ..... A63B 53/14 473/205
8,777,769 B2 7/2014 Pepe
9,233,284 B2 1/2016 Nathan
2004/0009833 A1 * 1/2004 Selevan ..... A63B 69/0086 473/576
2004/0107476 A1 6/2004 Goldwitz
2004/0132538 A1 7/2004 Oury
2007/0243940 A1 * 10/2007 McCree ..... A63B 53/14 473/201
2008/0282853 A1 * 11/2008 Young ..... B25G 1/10 81/489
2009/0217441 A1 * 9/2009 McCree ..... A63B 53/14 2/161.2
2009/0253530 A1 10/2009 Sugimae
2009/0321011 A1 12/2009 Ulrich
2010/0048319 A1 2/2010 Johnson
2010/0255921 A1 * 10/2010 Holdridge ..... A63B 69/3608 473/205
2010/0298063 A1 11/2010 Gill
2012/0017352 A1 * 1/2012 Waddell ..... A63B 47/001 2/161.1
2012/0159691 A1 * 6/2012 Phillippe ..... A41D 19/0031 2/69
2014/0038736 A1 * 2/2014 Pepe ..... A63B 69/3608 473/205
2015/0265890 A1 * 9/2015 Presse, IV ..... A63B 53/14 473/300
2016/0339310 A1 * 11/2016 Goldfader ..... A63B 53/14

* cited by examiner

METHOD AND SYSTEM FOR IMPROVING GOLF PUTTING ACCURACY USING A BIRDIE-LINE GOLF GLOVE AND STRAIGHT-EDGED PUTTER GRIP

RELATED APPLICATIONS

This application is a non-provisional of U.S. Provisional Patent Application Ser. No. 62/472,282 filed on Mar. 16, 2017. The entire disclosure of the prior application is considered to be part of the disclosure of the accompanying application and is hereby incorporated by reference.

BACKGROUND OF THE INVENTION

Golf is a recreational and competitive sport popular with large numbers of people of all ages. It is an admittedly difficult sport to master as it requires considerable skill and practice. In the more than 600-year history of the game of golf, mastery of the putting stroke has been the desire, if not the compulsion of every golfer. The putter is one of the maximum of 14 clubs carried by the golfer that must conform to the worldwide equipment rules established by the United States Golf Association and the Royal & Ancient Golf Association, St. Andrews, Scotland. In golf, a slight error in the angle of hitting the ball may result in a disastrous shot. Generally, the handle of the putter extends through the golfer's hands, and the precise position of the golfer's hands on the putter grip may be difficult to repeat.

Aside from the various aspects of golf that rely upon a proper golf swing, the act of putting a golf ball is critical to being able to score well in golf. Many golfers, however, struggle to maintain the proper grip of the putter for optimum feel and direction control when putting. Several factors are involved in putting accurately and consistently. One is to have a loose and relaxed grip without tightness in the hands, wrists, arms and shoulders so that the putting stroke can be free swinging from the shoulders with the putter hanging freely from the hands for a free pendulum swinging motion. Another factor is consistency in locating the hands on the shaft so that the controlled swing can be repeated consistently. Different distance putts require different length of stroke and if the hands grip the putter at different locations from putt to putt, it is difficult to judge the amount of swing to apply to obtain a desired distance for different putts. To putt accurately, the golfer must strike the ball along a precise line with a precise speed, taking into account both the contour and texture of the green's surface. Consistent alignment of the putter is required to putt a ball in the desired direction. Consistent alignment of the putter is required to putt a ball in the desired direction. Pros and amateurs alike struggle to find a consistent technique that will get the ball into the hole. When they tinker with their stroke, it is the putting grip that they most often change.

Putters are the only class of club allowed to have certain features, such as non-circular grip cross-sections, bent shafts or hosels, and appendages designed primarily to aid players' aim. According to the rules of golf, all club grips must have the same cross-section shape along their entire length (the diameter can vary), and with the exception of the putter, must have a circular cross-section. Unlike other clubs, the putter may have any cross section that is symmetrical along the length of the grip through at least one plane.

It is well recognized in the field of golf that a proper grip is essential for optimal performance. However, many individuals who wish to learn the sport struggle to develop a proper grip. Teaching aids have been developed to assist instructors when teaching new golfers but none of these teaching aids has proven entirely satisfactory. Moreover, in accordance with the official rules of golf, many of such training aids are prohibited for use during regular rounds of golf, and certainly for golfing tournaments. Moreover, players generally want to avoid having other players perceive their use of any aids, as it takes away from the perception of an individual's skill of the game. Thus, if an aid is to be employed, it should be both non-conspicuous, as well as legally employed under the governing rules of golf.

Putting methods and club designs have not changed dramatically for the last 100 years. The result of this lack of change has been a lack of improvement in putting skills by amateur golfers as well as professional golfers. The traditional putting methods are plagued with numerous sources of potential error, resulting in making the action so difficult that even few professionals have been able to master the task. Furthermore, the great plethora of putter designs that are introduced to the marketplace yearly gives testimony to the fact that very few putter designs include all of the features that are necessary to optimize the equipment for the intended task of even traditional putting methods.

Generally, golfers use at least one golf glove on their leading hand when playing golf. A majority of golfers use gloves to improve their grip of the golf glove relative to the bare human hand, which often provides less grip especially when sweating or when club grips are wet. When a glove is used to provide a more secure grip, the golfer wearing the glove correspondingly has more control of the golf club, thus theoretically enabling improvement of their golf game. The glove can also provide some added protection from vibration and abrasion, although such protection is relatively minimized by the thinness of the glove material. The conventional golf glove is formed of a very thin leather and/or synthetic material, that enables the user to feel the grip of the club through the glove. Common golf glove materials include leather, synthetic leather, spandex, blends with spandex, elastane, and other flexible and/or stretchable material. The material provides a smooth, wrinkle-free interface between the user's hand and the grip of the golf club.

A golf glove is often worn by golfers to provide for an enhanced grip when swinging the golf club. Many golfers, however, remove their golf glove to putt, believing that skin contact with the putter grip provides them with a better "feel" for the putter. The present inventor believes that this practice can further thwart the goal of consistently making putts. There is a long felt but unsolved need for a golf glove that can be worn by golfers when putting that improves their accuracy and consistency, thus improving their golf game.

SUMMARY OF THE INVENTION

A principal reason why golfers do not have mastery of the putting stroke is that a golfer does not consistently maintain a symmetrical relationship between the center line of the putter face surface and the optimal impact point at the sensible horizon on the center line of the golf ball. While the visual perception of the contour of the putting surface of the green, the grain of the grass, the distance between the ball and the cup, and the speed at which the ball will travel are influential on the outcome of the execution of the putting stroke, it is the precision of striking the ball by the putter at the optimal impact point that is critical to causing the ball to travel into the cup in the fewest number of strokes. This symmetry is essential in both direction and to transmit the immediate perpendicular rotational force transferred from the plane of the putter surface to the golf ball at the moment of inertia.

One objective of golf is to achieve birdie putts and remain under par. To achieve such a goal, amongst other things, an incredible consistency of putter stroke is required. The present invention provides for such consistency via a deceptively simple combination of features, each separately being on a putter grip and the other on a golfer's golf glove. Employing the present invention, a golfer is provided with the ability to simply line up his/her putt in a repeatedly consistent fashion, without having to employ any attachment features, convoluted markings as to where fingers, thumbs or club alignment features, etc. must be positioned, which may be observed by other golf players. The present invention provides a method and system that conforms to the rules of golf and improves the consistency of a golfer's putting stroke so that the golfer can make more birdie putts.

Traditional golf type putters include a putter head having a single ball striking face for stroking a ball, an elongated shaft connected thereto and a generally cylindrical, tapered handle. This type of handle or grip makes it difficult to maintain the club face in a square position relative to a given target line and various attempts have been made to modify putters in an attempt to keep the ball striking club face square to the line during the execution of a stroke.

The present invention relates to the employment of both a particular glove as well as a particular putter grip on a player's putter. As such, it is narrowly directed to a simple but entirely effective method and combination that presents a golfer with the ability to address each putt in a fashion such that the best opportunity is provided for consistently maneuvering the putter stroke so as to achieve accurate putting. By eliminating the clutter of features that is touted by various prior art devices, the golfer is able to simplify the putting stroke procedure with assurances that at least the association between the golfer's leading hand and the putter grip is a picture of consistency, such that other factors involved in putting, e.g. reading the break of the green, the speed of the greens, etc. may be focused on.

In various embodiments, the present invention involves the employment of a golf glove for use with a putter grip that has a straight edge, with the golf glove having a visual line alignment feature/illustration that allows a golfer to place his or her hand in a repeatable, proper position on the grip of the putter. Importantly, the golf glove is devoid of any putter attachment feature, such as hook-and-loop fastener material on the glove or the golf grip. The present invention is also devoid of a glove having any indicia affixed to the back hand portion of a glove, as it only complicates and confuses a golfer when putting—and may be the source of embarrassment or undesired attention as suggesting the player is achieving success only via the use of "training aids." The present invention is configured so that other players need never know of the simple but extremely effective system and method involved in the repeated ability to consistently putt better. Preferred embodiments include a golf glove that includes markings formed on solely the palm portion of a golf glove, e.g. such as a straight line that diagonally crosses the palm portion of the glove such that, when worn by a wearer, provides the wearer with a visual indication of the proper gripping position of a golf putter, such putter having a grip that has at least one flat surface and an edge extending down the axial length of the grip that can be aligned with the visual indicator markings/line on the golf glove, such edge able to be felt by the golfer through the surface of the golf glove palm.

Thus, the illustrated markings as provided on the golf glove correspond to the edge of a grip on a putter having at least one flat surface bordered by an edge, with the golfer's gloved hand being aligned with such edge right along the illustrated markings, such as a line provided on the glove that diagonally crosses the palm of the gloved hand. The grip of the club must be positioned right in the middle of the lead hand to achieve a consistent putt and the glove of the present invention provides assurances that each time a putt is attempted; the player will be assured that the precise palm position of the putter will be achieved. This is distinct from the use of a glove with a round gripped putter, as even if a glove is employed with such a round gripped putter, and even if the glove has illustrated markings thereon, there is no way for the golfer to have and enjoy the haptic fell of aligning the precise edge of the putter grip with the illustrated markings, as the putter grip on a round club grip, by its nature, possesses no such cornered edge.

The putter grips as employed in combination with the glove as described herein lacks any other physical contours or depressions that could assist the golfer with proper and consistent finger placement when gripping the club. Putter grips as used with the present invention are those manufactured to comply with the rules of the United States Golf Association ("USGA"), which call for a club grip that has no bulges or concavity. The only requirement of a putter grip that may be used in combination with the glove of the present invention is that it possess at least one angled corner perceptible by touch and feel by a golfer through the glove of the present invention. Preferably the golf putter grip has a flat surface that is 45-degrees angled from the front face surface of the putter face, e.g. that strikes the golf ball. Other embodiments, however, employ existing golf putters having a flat surface on their grip, such that there exists an angled portion that a golfer can feel through the glove when worn.

Employing the golf glove as described herein, in association with a putter grip as further described herein, e.g. one with a straight edge that may be aligned with the indicator markings/line on the glove, a golfer is provided with a precise and reliable tactile verification of correct hand positioning. Then using the glove of the present invention with a putter grip as described herein, a golfer is able to achieve consistent and repeated alignment of the putter with the ball and by doing so, significantly reduce the wrist movement and flex normally encountered with a round grip during the execution of a putting stroke.

One important constraint on improvements to the sport of golf is that the rules of golf must be complied with. As such, as useful as it would be for players to have custom fitted grips so as to achieve consistency of stroke, it is not permitted under the rules. The rules of golf are strict as to what is allowed and what is not allowed. Under Rule 14-3, a glove must "consist of a fitted covering of the hand with a separate sheath or opening for each digit (fingers and thumb)", and also must not have "features, other than visual aids, designed to assist the player in placing his hands in a consistent and/or specific position on the grip". Gloves may be worn to assist the player in gripping the club, provided they are plain. A "plain" glove must: consist of a fitted covering of the hand with a separate sheath or opening for each digit (fingers and thumb); and be made of smooth materials on the full palm and gripping surface of the digits; and must not incorporate: material on the gripping surface or inside of the glove, the primary purpose of which is to provide padding or which has the effect of providing padding. Padding is defined as an area of glove material which is more than 0.025 inches (0.635 mm) thicker than the adjacent areas of the glove without the added material. Nor may it have material on the glove that adheres to material on the grip. The glove cannot have features, other than visual aids, designed to assist the player in placing his hands in a consistent and/or specific position on the grip; it may not have any feature that might restrict the movement of a joint.

Appendix II, 3 of the Rules provide more specific parameters for the grip and provides that a continuous, straight, slightly raised rib may be incorporated along the full length of the grip, and a putter grip may have a non-circular cross-section, provided the cross-section has no concavity, is symmetrical and remains generally similar throughout the length of the grip. The grip may be tapered but must not have any bulge or waist. Its cross-sectional dimensions measured in any direction must not exceed 1.75 inches (44.45 mm). "Slightly raised" is interpreted to mean that the maximum and minimum diameters of the cross-section at any point must not differ by more than 0.040 inches (1.016 mm). Additionally, the dimension of the rib width, from edge to edge, should not exceed 50% of the grip's internal diameter.

In the case of a standard length grip (approximately 10 inches (254 mm) in length), the "full length of the grip" is interpreted to mean that the rib must extend to within 3 inches (76.2 mm) of the tip. The overall consideration is that a grip "must not be molded for any part of the hands." If a certain feature on the grip enables the player to place his hands in exactly the same position every time, solely by feel and without actually looking at the grip, then it must be determined whether that feature renders the grip "molded for the hands." An extreme example of a grip which would be ruled "molded for the hands" is the type of "training grip" often used to help beginners. However, a grip which has subtle changes in surface texture would usually be considered conforming. Likewise, printed markings which assist with the correct placement of the hands visually would normally be considered conforming.

Using the combination of the glove and the grip as described herein, a golfer is able to keep the club head completely "square" throughout the putting stroke without hand and forearm contortion. It is therefore one object of various embodiments of the present invention to provide a golf glove with a guide line to show the exact placement of the putter to insure proper gripping of the putter grip along the edge of the putter grip, whether the grip is a square, rectangle, triangle, or other configuration, as long as the grip has a straight edge that extends down the length of the grip and that can be felt through the glove when a golfer aligns the indicator marking (running diagonally along the golfer's palm on the glove) with the edge of the putter grip.

To achieve a proper grip of the putter, a wearer of the golf glove having a "birdie-line" as described herein, receives a putter grip having at least one palm facing straight edge that extends down the grip and that can be aligned with the markings on the glove. The right or ungloved hand then grips the putter according to the golfer's preference.

A golfer wearing the gloves receives the grip portion of the putter having the grip configuration as described herein, and the golfer can then align the edge of the grip with the markings or line across the palms of the glove, such that the putter grip and associated putter shaft will lie diagonally across the roots of the fingers. Then, when the hands are closed around the putter grip, an automatic proper gripping of the putter will be insured.

Another object of the invention is to provide a golf glove for the upper gripping hand of a golfer which when receiving there against the shaft of a putter having a grip as described herein, when the putter is soled on the ground, will automatically present the hand of the golfer to the putter grip in a proper gripping position.

The preferred putter grip is square, rectangular or another polygonal shape that has at least one palm facing edge that a golfer is able to feel through the glove so as to facilitate alignment with the visual markings, such as a straight line extending diagonally across the pam side of the glove. The putter grip preferably has at least one flat side that is adjacent to an edge that may be aligned with the palm line on the glove. In preferred embodiments, there is no corresponding visual indicator on the golf grip itself, but rather the alignment with the physical edge of the putter grip is all that is employed, such that the haptic feel of the putter grip is all that is required for a player to align the line on the palm of the glove with the edge of the putter grip. The glove of the present invention is not intended to just be a training aid, but instead is to be used by players in USGA approved tournaments, as the glove and the combination with a putter grip having at least one edge that aligns with the palm line on the glove, is fully in accordance with the Rules of Golf.

In a particularly preferred embodiment a particular putter grip is employed. A preferred putter grip has a flat surface that is at about 45-degree angle from the front face of the putter head face such that when the putter grip is held by a golfer (wearing the glove as described herein) the visual markings/line on the palm of the glove is aligned with the 45-degree flat surface of the putter grip. This is illustrated in FIG. 2. By the combination of this unique putter grip and the alignment of the glove with such surface, a golfer is able to simply, repeatedly and consistently achieve a putting stroke that improves the putting game by the golfer.

In one embodiment, the glove has a line imprinted thereon that aligns with the edge of a golf putter grip having an edge thereto, such as a rectangular or square golf grip. Thus, a golfer wearing the present glove is able to align the extending line on the palm surface of the glove with the edge of the golf putter, and in so doing, consistently grip the putter, adding to the ability of the golfer to perform his/her putting stroke with more confidence and assured that the mechanics of their individual stroke will not be adversely affected by the even subtle changes of their hands on the grip of their putter.

One will appreciate that this Summary of the Invention is not intended to be all encompassing and that the scope of the invention nor its various embodiments, let alone the most important ones, are necessarily encompassed by the above description. One of skill in the art will appreciate that the entire disclosure, as well as the incorporated references, pictures, etc. will provide a basis for the scope of the present invention as it may be claimed now and in future applications. While embodiments of the invention have been illustrated and described, it is not intended that these embodiments illustrate and describe all possible forms of the invention. Rather, the words used in this specification are words of description rather than limitation, and it is understood that various changes may be made without departing from the spirit and scope of the invention.

DETAILED DESCRIPTION OF CERTAIN EMBODIMENTS OF THE PRESENT INVENTION

Figure 1:
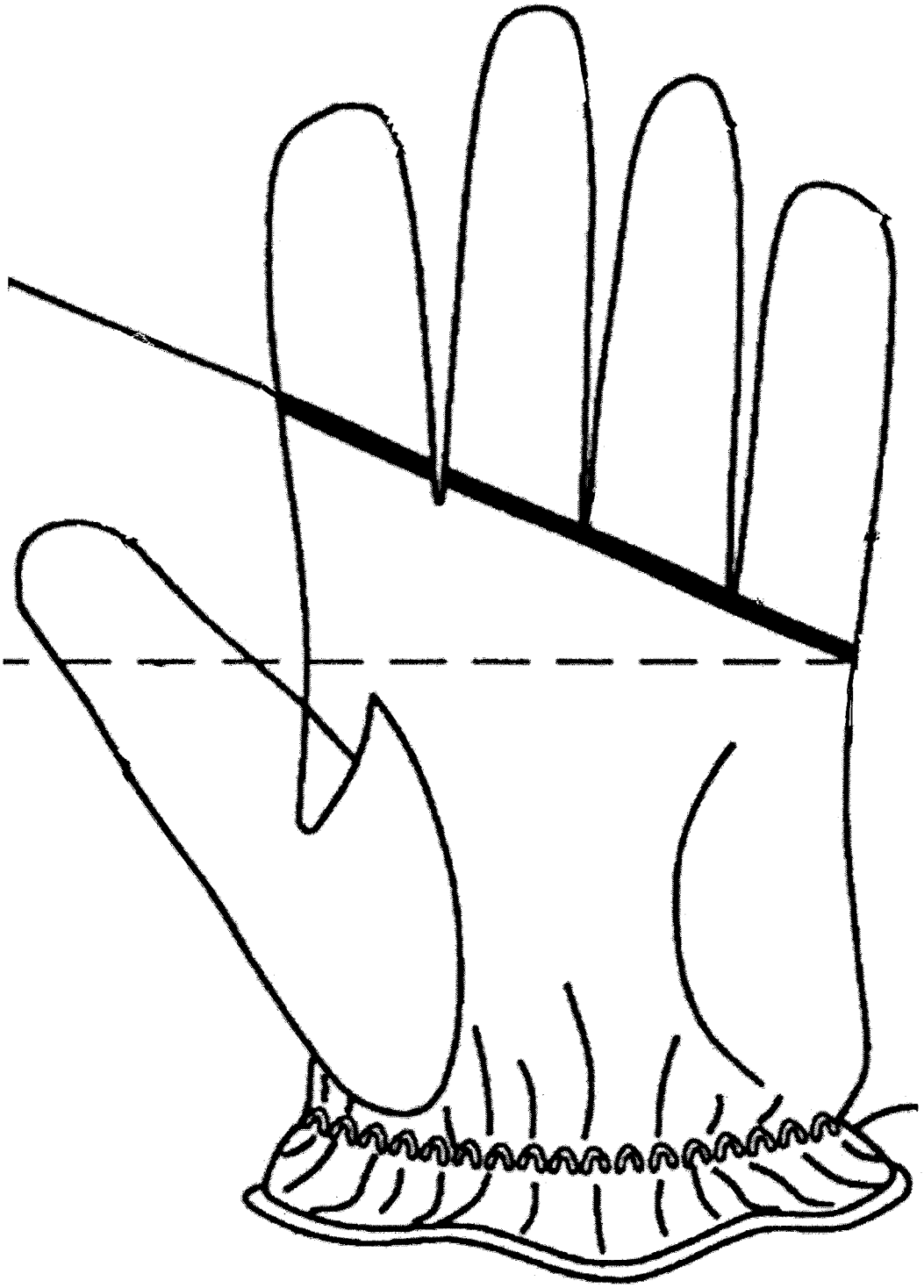
FIG. 1 is a plan view of the anterior surface of a golf glove showing the guide line and its position according to this invention.

The physiological and neurological sequencing skills requisite of mastering the putting stroke are particularly significant due to the fact that the putter is the most-often stroked club by the golfer. Consequently, a precisely-practiced putting stroke is essential to the outcome of a golfer's score on each of the 18 holes during the game of golf.

The present invention relates to a combination of a golf glove and a particularly shaped putter grip to assist a golfer in attaining the proper grip of a putter. Although golfers typically use both hands when making a putt, the hand that is closest to the end of the putter and closest to the golfer's body, hereinafter referred to as the "upper hand," is the one primarily responsible for properly gripping the putter. Therefore, the primary purpose of the present device and method is to properly align a golfer's upper hand to achieve a proper grip of a putter. A proper grip by the upper hand is one that allows for the most efficient radial deviation (abduction) and ulnar deviation (adduction) as well as flexion and extension of the wrist, while also minimizing club head or shaft axis rotation during the putting stroke.

Golf gloves are typically made from materials that reduce slipping of the putter in the hand of the golfer. For example, gloves are made from either leather and/or synthetic material. Leather and/or synthetic material create friction between the glove and the putter during the swing of the golfer. The friction reduces slipping of the putter which in turn provides the golfer with a firmer grip. The golf glove must also fit snugly on the hand of the golfer to ensure a firm grip. A glove that fits loosely on the hand of the golfer allows the glove to move during the swing of the golfer. If the glove moves, the golfer may not maintain a firm grip on the club.

A proper grip can only be achieved by correctly positioning the putter grip in relation to the pisiform and triquetrum carpel bones of the golfer's hand, which can create a grip that is substantially different than that described in the existing prior art. The location of these bones is important, because when they are positioned correctly, the wrist of the upper hand of the golfer is locked in the proper position and cannot rotate about the putter's longitudinal axis. Rotation about the longitudinal axis of the putter can cause the face of the club to contact the golf ball at improper angles, which can change with each putt. When the pisiform and triquetrum carpel bones of the golfer's upper hand are in the correct location on the putter, the face of the putter will contact the ball at a predictable angle with every putt.

Disclosed in this specification is a golfing glove that is configured to facilitate the proper grip of a golf putter and a method of using the same. The palmar surface of the glove comprises a first indicator that extends diagonally along its width. In certain preferred embodiments, the glove has a visual line that is aligned with the edge of a putter having a grip that has at least one straight edge, such as a square or rectangular. Thus, in various embodiments the present invention requires the combination of a particular putter grip used in conjunction with a golf glove as described herein to achieve the objective of proper repeated and consistent alignment of a golfer's gloved hand with a putter grip having a straight edge that aligns with a visual marker on the palm of the glove.

The shape of the putter grip must be in keeping within the rules of golf, as prescribed by the U.S. Golf Association. It is well known to use putter grips with a flat surface perpendicular to the club face for the purpose of providing a reference point to aid a golfer in keeping the ball striking face square to the target at impact with the golf ball. This structure conforms with the rules of golf.

FIG. 1 is a plan view of the anterior surface of a golf glove showing the guide line and its position according to this invention.

Figure 2:
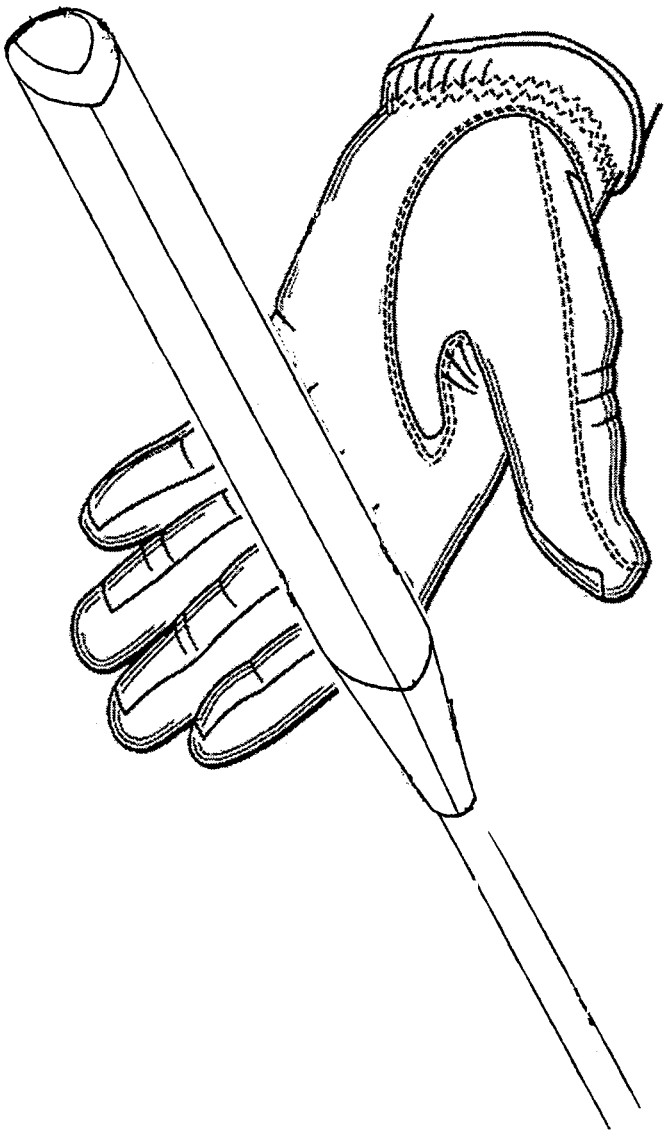
FIG. 2 shows a 45-degree flat face of a putter grip that is aligned with a visual marking/line that extends across the width of the palm of the glove, accommodating the preferred crossover grip for a putting stroke by a right handed golfer.

FIG. 2 shows a 45-degree flat face of a putter grip that is aligned with a visual marking/line that extends across the width of the palm of the glove, accommodating the preferred crossover grip for a putting stroke by a right handed golfer.

Golf gloves are commonly used to prevent the golf club from slipping in the golfer's hands and are typically made from a material such as leather, which creates friction when placed in contact with the grips typically found on a golf club where the golfer places his or her hands when gripping it. In addition to this anti-slip function, the golf glove of the present invention is configured to provide a consist way for a golfer to putt accurately. In preferred embodiments, no additional illustration, stickers, etc. are employed on the putter grip itself, in contrast to various teachings of the prior art. In other words, the more a golfer shows his golfing companions that he/she is relying upon features to gain an advantage in the sport, the less attractive such "aids" are in practice. Thus, one aspect of the present invention appreciates that the minimal nature of the present invention, employing pre-existing putter grips in association with the novel gloves of the present invention, in combination provides for a way for a golfer to vastly improve their golf game scores without the attendant embarrassment that sometimes is associated with the use of golfing aids. Thus, the present invention does not contemplate the use of a marking system that can be placed on clubs when they are manufactured or retrofitted onto clubs that did not originally comprise such markings. By providing visual cues on the golf glove for proper alignment with a physical feature of particular putting grips, the golf glove visual alignment illustration across the palm of the glove is alone sufficient to achieve the objectives of consistently better putting strokes. Using the present invention, a golfer can consistently obtain the proper grip on their putter, which can lead to more predictable putts and a consistently better golf score, hence the name of the glove: Birdie-line golf glove.

Some in golf have opined that the positioning of the hands on the grip is not as important as you might think, and how one puts both hands on the grip and whether fingers are linked or whatever is not the main or even much of a determining factor in good putting—instead believing and emphasizing a triangular shoulder moving exercise to promote consistent putting.

The present inventor disagrees. The present invention includes a glove with a predetermined visual indicator of where the putter should align with the gloved hand of a golfer, with the putter grip having a straight edge that extends down the grip and that can be felt through the glove by the golfer, with only the glove having a single simple visual indicator of how a putter grip is to be aligned (as opposed to any other grip for other golf clubs). In one embodiment, the glove and the putter grip are packaged together as a kit. In various embodiments, the present invention is devoid of any adhesive indicators or more than one visual marker on a glove, as additional clutter only detracts from the objective of a golfer when putting. The present invention is therefore devoid of many of the features taught in the prior art, such as the use of VELCRO, straps, adhesive elements, etc. To be a great putter, the putter face needs to be square to the intended target line at impact. The present invention, employing the combination of a particularly configured putter grip and a golf glove with a simple illustration across the palm of the glove that aligns with the edge of a putter grip, provides a proven system that promotes consistency and confidence on the green. Wrist breakdown is the bending or twisting of the wrists during the putting stroke. It leads to inaccurate putts. An interesting irony is that early in the history of the game wrist break was an important part of putting. Golfers were encouraged to flick their wrists during the putting stroke. Later on, however, professionals and amateurs alike proved that greater accuracy and consistency could be achieved by keeping the wrists steady for the entire duration of the stroke.

Some others in golf advise players to remove their golf gloves to obtain a "better feel" of the golf putter so as to presumably make a better putting stroke. The present invention teaches away from such advice and instead, is founded on the belief that the proper orientation of the putter to a player's hand grip and ensuring that each and every time that such grip is performed, that it provides a maximum of consistency, is a key attribute to better and more consistent putting strokes.

Prior art golf gloves have been designed which use padding and other means that force the user to place the club into a specific position in his or her hand. In contrast to such prior art teachings, the present invention does away with such features and focuses on the simple yet effective employment of a visual marking on the palm of a glove, used in combination with a putter grip having a straight edge that can be felt through the glove. The gloves of the present invention are devoid of ridges formed on the finger or palm portion of the golf glove.

For a novice to learn to play golf well they need to concentrate initially not only generally on their posture/stance and putting stroke, but also very importantly on how they grip the putter as an incorrect grip will greatly affect the putting stroke. This fact has not escaped the attentions of the golf equipment industry and a number of proposals have been made for golf grip training aids. The trainee continues to use them until he or she has built up the necessary muscle memory and no longer needs the training aid. Some such aids have specially formed handle grips that are molded to provide contours for the fingers and thumbs to follow to guide them to achieve the correct grip position. These are not normally coordinated with gloves. Indeed, there is a large contingent of golfers who believe that the use of a glove while putting is disadvantageous, as they reduce the "feel" of the putter and thus, arguably reduce the ability of a golfer to putt well. May golfers state that it is good to be able to 'feel the putter in their hands.' The present invention permits one to complete a putting stroke with the putter face always on-the-line-of-the-putt and square to the target. Those opposed to the use of golf glove when putting argue that a golfer's fingers have some of the densest areas of nerve endings on the body which are the biggest source of tactile feedback and have the greatest positioning capability of any part of the body. They contend that this tactile feedback and positioning capability is something that is extremely useful when trying to putt, and that a glove interferes with such sensitivity. In truth, however, a golfer attempting to constantly trying to feel how their hands are positioned or moving them around on the putter grip—is an almost sure-fire way to miss a lot of putts—as the confusion that it creates destroys any confidence and prevents the consistency required to score well at golf.

Unlike prior art devices, systems and methods, the present invention does not require a golfer to visually estimate an angle, e.g. as does the invention as described by Liu., etc. Nor do the gloves of the present invention require or contain any indication, symbol, etc. on the top side of the gloves, thumbs, indicators on top of the knuckles, etc. that purportedly point to regions of the golfer's anatomy or otherwise indicate on the outside of the glove any proper positioning of the glove on the putter. In certain embodiments, the glove selected with a visual indicator extending across the palm of the glove properly aligns the pisiform and triquetrum carpel bones of a golfer in relation to the putter grip, again by the haptic feel of the edge of the putter grip felt by the golfer through the glove, thus permitting proper alignment therewith. The visual markings on the glove of the present invention are devoid of cushioning or any conformance materials other than the simple single layered golf glove material (e.g. leather, etc.) that comprises the glove. The markings are located on the palm of the glove so that contact between the marks on the glove and the edge felt by the golfer when contacting the putter grip can be visually confirmed and precise positioning of the golfer's hand on the putter can thereby be achieved.

In use, a method that employs the use of the golf glove/putter grip combination of the present invention and involves: lining up a putt by sighting down the green terrain to the hole to get the line of the putt; placing the putter in the golfer's palm having a hand gloved with the present glove, which has a diagonally extending line across the palm region; and aligning, using the feel of the edge of the square/rectangular, polygonal putter grip through the glove, so that the visual markings/lone overlaps the edge of the putter grip. The putter head is then drawn straight back on the "line of the putt" and then—with the dominant hand (i.e. right for right-handed)—move the putter head straight forward and straight through the ball, all on the same "line of the putt". The putter head thus remains "square" to the line-of-the-putt throughout the stroke using the present invention. This happens because the glove position, and thus, the position of the leading hand of the golfer gripping the putter, is in line and consistently permits the golfer to repeat a given stroke without the guesswork that would otherwise be involved if, for example, a round gripped putter was employed, and/or with a glove without a palm visual indicator that aligns with an edge of a putter grip is provided.

To comply with written description and enablement requirements, all references cited herein, including but not limited to published and unpublished applications, patents, and literature references, are incorporated herein by reference in their entirety and are hereby made a part of this specification. To the extent publications and patents or patent applications incorporated by reference contradict the disclosure contained in the specification, the specification is intended to supersede and/or take precedence over any such contradictory material. Incorporated herein by this reference are the following US patent publications: U.S. Pat. No. 8,096,893 to Ferris; U.S. Pat. No. 3,459,426 to Sherwood, U.S. Pat. No. 4,537,403 to Farina; U.S. Pat. No. 5,993,327 to Terrell; U.S. Pat. No. 3,109,653 to Biggs, U.S. Pat. No. 5,460,372 to Cook, U.S. Pat. No. 4,746,120 to Mockovak, U.S. Pat. No. D377,070 to Gurrola, U.S. Pat. No. 5,133,555 to Bailey, and U.S. Pat. No. 6,110,054 to Rodarte; U.S. Pat. Nos. 3,848,874, 6,272,686, WO2000/0020078 and WO2007/120058; US2004/132538; U.S. Pat. No. 6,272,686 to Liu; U.S. Pat. No. 3,848,874 to Elkins, Jr.; U.S. Pat. No.

6,698,027 to Park; U.S. Pat. No. 5,836,828 to Sinton; U.S. Patent Application No. 2007/0243940 to McCree; U.S. Pat. No. 4,000,903 to Swanson; U.S. Pat. No. 3,863,271 to Moroney; U.S. Pat. No. 2,258,999 to Nunn; U.S. Pat. No. 4,329,741 to Bach; U.S. Pat. No. 3,648,292 to Strickler; and U.S. Pat. No. 5,253,367 to Lappley; U.S. Pat. Nos. 5,253,367; 3,848,874 to Elkins; U.S. Pat. No. 4,962,547 to Minnick; and U.S. Pat. No. 5,634,214 to St. Ville; U.S. Pat. Nos. 1,677,099; 3,219,348 and 3,263,998; U.S. Pat. No. 5,253,367; US 20040107476 to Goldwitz; U.S. Pat. No. 6,272,686 to Lui; U.S. Pat. No. 5,715,539 to Benecki, et. al, 20090321011 to Ulrich; 20100298063 to Gill; US20100048319 and U.S. Pat. No. 7,794,332 to Johnson; U.S. Pat. No. 8,092,317 to Johnson; US20090253530 to Sugimae; U.S. Pat. No. 5,123,646 to Overby; U.S. Pat. No. 8,777,769 to Pepe; 20090217441 to McCree; U.S. Pat. No. 9,233,284 to Nathan; and U.S. Pat. No. 6,902,492.

In particular embodiments of the present invention, a magnetic line is provided on the golfer's golf glove that is positioned across the width of the glove palm region so as to indicate the proper alignment of the glove with the putter grip, which has an oppositely polarized magnetic strip extending down the extent of the grip, thus permitting a golfer wearing such glove to more easily align his gloved hand into a proper aligned position with the putter grip when gripping the putter grip. The magnetic attraction of the magnet in the glove and either the opposing magnet of opposite polarity in the putter grip, or alternatively an iron or other magnetically attractive element in the putter grip, provides subtle but effective guidance as to proper and desired positioning of the golfer's gloved hand on the grip of the putter. In preferred embodiments, the grip of the putter has at least one edge that a gloved hand of a golfer can detect through the glove, thus permitting alignment of the region across the width of the glove—which preferably has both a visual indicator of a proper alignment of the grip of the putter with such line across the fingers/palm of the glove (e.g. as depicted in the figures). As one of skill in the art will appreciate, the glove or the putter grip may contain a magnetic component that attracts either an opposing magnet in the glove/grip, with the other glove/grip component having simply having an iron containing element so as to be attractive magnetically to a magnetic stripe as provided in the opposing article—e.g. glove or grip. In still other embodiments, the glove and the grip are devoid of hook and loop fasteners (VELCRO®) that prior art systems have employed, and in still other embodiments, the present invention does not employ magnetic elements to align the glove and the grip.

Moreover, embodiments of the present invention are devoid of any "channel" on a golf grip for a putter. Unlike certain prior art devices employed in golf, where alignment channels are employed to serve a "reminder" function, a cavity in the golf grip of the present invention is not used. Instead, the edge contour referred to herein is the opposite of a channel (e.g. depression) and can be felt as a feature of the golf grip that can readily be used as an alignment feature such that a golfer wearing the glove as described herein, can be properly aligned with the grip of the putter. In such a manner, the golfer is able to feel the edge and to align with the glove line across the width of the glove palm.

The combination of the glove markings being aligned with the putter grip in the various ways as described herein permits a golfer to know whether they are grasping the golf grip with a proper hand and finger placement such that the golf club face is properly aligned. The combination of knowing that the golf grip is precisely aligned with the glove line on the palm of the glove provides the golfer to perceive by feel that the golf grip has been grasped correctly, thus creating a higher level of confidence in the golfer, which results in a better golf stroke.

In a particular embodiment, a magnetic attraction is provided between a stripe or line of a golf glove and a vertically extending line in a putter grip (that can be positioned on existing as well as new putters-thus providing for retrofitting existing putters to employ the present invention. In one particular embodiment, the width of the glove palm line as well as the width of the corresponding grip line is 1.5 millimeters, with elevation of a feature on the golf grip being no more than 0.5 millimeters, with such illustration marker on the glove and the edge features of the grip, alone or in conjunction with a reminder rib on the rectangular golf grip, allows the golfer to determine by tactile perception the orientation of the golf grip with respect to the golf club face.

In certain embodiments, the visual and tactile confirmation made possible via the interface between the described golf glove and golf grip of a putter, includes the use of the edge of a golf grip having at least one flat surface such that the glove line can be aligned with the grip to confirm with more precision that the golf grip is in a desired orientation relative to the golf club face. Preferably, the edge of the grip on the putter that is aligned with the line on the glove of the present invention is in the rear portion of the grip (in relation to the putter club face). By using the present invention in one of its embodiments, a golfer's ability to determine by tactile perception the orientation of the golf grip—provided they employ the lined golf glove of the present invention, with respect to the golf club face, is maximized. Reliance on motor memory will therefore be replaced with the far more consistent application of a golf glove and putter grip, thus providing the golfer more confidence that they are aligning the golf club face correctly.

In certain embodiments, the invention comprises a kit having both a glove and a grip for a putter with the glove having an indicator that aligns with a structural ribbed feature of the golf grip so that the golfer can repeatedly and confidently place their gloved hand on the putter, with the ability to align the visual indicator on the glove with the tactile feeling of the golf grip rib. Thus, the present invention resolves an issue the golf industry has largely ignored and provides an easy and repeatable way for a golfer to putt in a fashion such that when putting, he/she solves the problem of the long felt but unsolved issues relating to a golfer's inability to consistently putt a golf ball in a repeatable hand/grip coordinated manner. The problem of incorrect positioning of the golfer's hands on the putter grip remains prevalent, leading to inaccurate and inconsistent putting by the golfer. Thus, various embodiments are directed to a combination of a golf glove and corresponding putter grip to facilitate the proper grip of a putter. In various embodiments, there is an absence of any "butt-end alignment", further distinguishing the present invention, in its various embodiments, from the prior art. In other embodiments, only a single reminder is placed on the on the grip for which a golfer lines up using tactile feel of the underlying grip feature (e.g., edge) with a visual indicator (e.g. line) on the golfer's glove.

In contrast to prior art teachings, the present invention does not employ a method or system that depends upon the provision on a golf glove of a marking for the position of a thumb a to assist a golfer to correctly position their hands on a golf club grip. The sole indicator or marking on the glove of the present invention is provided to reveal the line with which the golfer is to align with the putter grip via the feel, through the glove, with a predetermined edge of the putter.

Thus, steps of the present method include wearing by a golfer of a glove having a sole marking across the width of the palm of the glove, as depicted in FIG. 1. Then a golf putter is selected that has an edge extending vertically down the extent of the putter grip. The golfer aligns his/her gloved hand with the edge of the putter via feel of the edge through the glove, thus aligning the indicator line of the glove with the edge of the putter. By doing this each time the putter is use, the golfer attains superior consistency of putting. Thus, in various embodiments, the only reference indicia on the glove is the reference line extending across the base of the fingers on the palm side of the glove Certain aspects of the present invention focus on the popular grip whereby a right handed golfer has his/her gloved left hand lowermost on the golf putter grip with the back portion of the gloved hand pointing substantially toward the hole, with the opposing right hand then being positioned on the upper end of the putter grip. This is distinct from a more conventional grip employed by a right-handed golfer using a conventional gripping style, whereby an upper portion of the grip is where a majority of the golfer's left hand would grasp the golf grip and the lower portion is where a majority of the golfer's right hand would grasp the golf grip. Thus, certain aspects of the present invention are directed, for the first time, to a golf glove that is specifically designed so that it has a visual indicator that conforms to the "cross-over" grip described herein and that permits the tactile registration of the glove with the grip to achieve the long desired consistency of a putting stroke. The glove indicator coincides with the preferred hand and finger placement on the putter grip, as determined by the golfer being able to tactilely perceive the visual alignment of the glove markings and the underlying putter grip structural features, e.g. an edge with which to align with the visual glove indicator, thus providing the golfer with a higher level of psychomotor confidence, which results in a better golf stroke. While one will appreciate how this very subtle and precise psychomotor alignment is, they will also appreciate that it is through this visual/tactile alignment, repeatedly achievable via the present invention, that ultimately leads to better putter strokes, vastly improving the opportunities for birdies.

As one will appreciate given the guidance provided herein, various grip designs can be employed to match up with desired putting strokes of individual players. The principal point is that the ability to consistently grip the putter (e.g. by relying on the visual alignment feature on the golf glove and the tactile feel of a structural feature on the putter grip that co-aligns with the visual feature) renders it possible for a golfer to cut strokes off their typical game, all while employing a simple, rule-abiding combination of a particular glove and putter grip. The angles of the visual indicators on gloves can vary, e.g. a 45-degree line, 60-degree line, etc. as long as the lines correspond to and align with tactile structural features of the golf grip.

In various embodiments, the present invention is not directed to providing a golfer with any guidance as to how they should grip a non-putter club, but rather, the glove of the present invention, when used in combination with the grips for a putter, is the sole objective and focus of the present invention. Importantly, other prior art gloves taught by others often are directed to gloves which provide a visual indication, through the use of markers and other visual indicia, to present a golfer with a "strong" and/or "weak" grips, etc. That is not the focus of the present invention, which is solely directed to a glove for use in putting and that permits the golfer to prepare to putt consistently without any outward indication to other players (e.g. due to the palm facing line on the birdie-line glove) and its alignment with the golf grip on the putter that has an edge such that consistent and proper alignment can be achieved in a repeated fashion.

The provision of a glove and a putter grip combination, preferably offered to the golfer as a kit, such that they can replace their existing putter grip with the new putter grip (having the edge for alignment with the birdie-line glove) permits a golfer to employ their own putter to achieve improved putting performance.

The provision of a particular grip having either a flat face—and thus an edge that can be felt through the glove, and/or a slightly raised rib that can also be felt through the glove—together with a glove as described herein (e.g. one that has a visual line that provides direction to a golfer as to how they should properly align their gloved hand with the putter grip) forms a commercially valuable business opportunity. Golfers who desire to improve their golf game but who have made an investment (either emotionally or monetarily) in their golf putter(s) can now, using the present invention, replace existing putter grips with the putter grips as described herein, and with the golf glove as described, align their hands with their "re-gripped" putter to attain the objective of getting more pars and birdies during their golf outings. Thus, instead of the common but expensive practice of repeatedly purchasing putters in a vain attempt to improve their golf score, golfers can now select their favorite putter(s) and modify the same by replacing the putter grips with those as described herein, and then using such putter grips with their favorite putters, together with the described gloves having the predetermined "birdie-line(s)" that permit the golfer to properly align their hands with the putter grip to achieve the previously elusive consistency of a confident and repeatable putting stroke. Thus, in one embodiment of the present invention, a kit is provided that has both a putter grip and a birdie-line glove as described herein, generating an entire industry based on retrofitting existing putters in a manner that conserves the golfer's money and cherished putters, while improving the golfer's success and scoring on the golf course using such putters. While the "birdie-line" gloves may be employed with existing putters have an existing grip that has an edge or a "slightly raised rib" as permitted by the rules of golf, it is most preferred to use the birdie-line gloves with a specially manufactured putter grip, so as to ensure that the geometries of the line on the glove properly align with the grip(s) on the putter as described herein.

While embodiments of the invention have been illustrated and described, it is not intended that these embodiments illustrate and describe all possible forms of the invention. Rather, the words used in this specification are words of description rather than limitation, and it is understood that various changes may be made without departing from the spirit and scope of the invention.

What is claimed is:

1. A method for achieving a proper golf grip position for a cross-over putting grip using a guide line on a golf glove in combination with a straight edge on a putter grip, comprising the steps of:

providing a golf glove having a palm surface, and a base finger portion at a base of an index finger, a middle finger, a ring finger, and a little finger, and a guide line indelibly illustrated on the palm surface and that extends diagonally across the palm surface of the glove, the guide line passing across the base finger portion and that slopes at an angle of 20-30 degrees from a phantom straight line drawn horizontally across the palm surface of the golf glove;

providing a putter grip that has a lower portion and an upper portion that has a single continuous longitudinal straight edge extending at least down the lower portion, said straight edge being configured so that it can be felt by a golfer wearing a golf glove;

gripping the lower portion of the putter grip with the golf glove by superimposing the straight edge of the grip longitudinally over the guide line on the palm surface of the glove so that the guideline is lined up with the continuous longitudinal straight edge, whereby the putter grip co-aligns with the guide line to provide the golfer with a tactile structural feature that is repeatedly achievable to produce a more consistent putter stroke;

wherein only the indelibly illustrated guide line glows in the dark;

wherein said golf glove is devoid of any hook and loop fasteners to indicate positioning of a golfer's hands on a putter;

wherein the continuous straight edge has a single 45 degree corner; and wherein the glove and the putter grip are packaged together as a kit.

2. The method as set forth in claim 1, wherein the continuous straight edge consists of a 45-degree angle from a flat surface of the putter grip.

3. The method as set forth in claim 1, wherein the putter grip is devoid of any visual indicator adapted to line up with the guide line on the glove.

4. The method as set forth in claim 1, wherein the golf grip is devoid of any depression that could assist the golfer with a consistent finger placement when gripping the putter.

5. A method for achieving a proper golf grip position for a cross-over putting grip using a guide line on a golf glove in combination with a straight edge on a putter grip, comprising the steps of:

providing a golf glove and a putter grip in a kit, said golf glove having a palm surface, and a base finger portion at a base of an index finger, a middle finger, a ring finger, and a little finger, and an indelibly illustrated guide line on the palm surface that extends diagonally across the palm surface of the glove, the guide line passing across the base finger portion and that slopes at an angle of 20-30 degrees from a phantom straight line drawn horizontally across the palm surface of the golf glove, said indelibly illustrated guide line being the only feature on said glove that glows in the dark and said golf glove having a top surface that is devoid of any markings to indicate positioning of a golfer's hands on a putter;

wherein the putter grip has a lower portion and an upper portion and that has a single continuous longitudinal straight edge extending down the lower portion, said single continuous longitudinal straight edge having an angle of 45 degrees and configured so that it can be felt by a golfer wearing the golf glove when the golfer aligns said edge with the indelibly illustrated guide line, said golf grip being devoid of any depression that could assist the golfer with a consistent finger placement when gripping the putter;

gripping the lower portion of the putter grip with the golf glove by superimposing the single continuous longitudinal straight edge of the grip longitudinally over the guide line on the palm surface of the glove so that the guideline is lined up with the single continuous longitudinal straight edge, whereby the putter grip co-aligns with the guide line to provide the golfer with a tactile structural feature that is repeatedly achievable to produce a more consistent putter stroke;

gripping the upper portion of the putter grip with an ungloved hand; and putting a golf ball.

6. The method as set forth in claim 5, wherein the putter grip is devoid of any visual indicator having a color distinct from the color of the putter grip and that is adapted to line up with the guide line on the glove.

* * * * *